US009119506B2

(12) United States Patent
Shendelman

(10) Patent No.: US 9,119,506 B2
(45) Date of Patent: Sep. 1, 2015

(54) AERODYNAMIC DEVICE FOR USE IN ORGANIZING AND HOLDING FOOD AND LIQUID SUBSTANCES AND EATING UTENSILS AND FOR SUBSEQUENT RECREATIONAL USE

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 0 days.

(21) Appl. No.: 14/194,972

(22) Filed: Mar. 3, 2014

(65) Prior Publication Data

US 2014/0248818 A1 Sep. 4, 2014

Related U.S. Application Data

(60) Provisional application No. 61/771,428, filed on Mar. 1, 2013, provisional application No. 61/790,285, filed on Mar. 15, 2013.

(51) Int. Cl.

| | |
|---|---|
| ***A63H 27/00*** | (2006.01) |
| ***A63H 33/00*** | (2006.01) |
| ***A47J 43/00*** | (2006.01) |
| ***A63H 33/40*** | (2006.01) |

(52) U.S. Cl.
CPC *A47J 43/00* (2013.01); *A63H 33/40* (2013.01)

(58) Field of Classification Search
USPC ..... 446/46–48, 71; 434/127; 220/575; D7/553.6, 555, 557
See application file for complete search history.

(56) References Cited

U.S. PATENT DOCUMENTS

| | | | | | |
|---|---|---|---|---|---|
| 1,576,088 | A | * | 3/1926 | Bunz | 220/575 |
| 2,561,022 | A | * | 7/1951 | Jones | 220/23.6 |
| D176,824 | S | * | 1/1956 | Sacia | D7/555 |
| D188,502 | S | * | 8/1960 | Metzler | D7/555 |
| D192,374 | S | * | 3/1962 | Wittke | D7/555 |
| D194,054 | S | * | 11/1962 | Grossman | D7/556 |
| D281,849 | S | * | 12/1985 | Cantor | D7/555 |
| 4,940,441 | A | * | 7/1990 | Novinsky | 446/46 |
| 5,366,403 | A | * | 11/1994 | Weiss | 446/46 |
| 5,593,062 | A | * | 1/1997 | Martin | 220/574.1 |
| 5,873,761 | A | * | 2/1999 | Johnson | 446/47 |
| 5,925,390 | A | * | 7/1999 | Kornacki | 426/87 |
| D415,421 | S | * | 10/1999 | McCann | D9/428 |
| D483,999 | S | * | 12/2003 | Beachum et al. | D7/553.6 |
| D494,012 | S | * | 8/2004 | Bandy-Helderman | D7/553.6 |
| 7,007,290 | B2 | * | 2/2006 | Wilcoxson et al. | 720/718 |
| D552,934 | S | * | 10/2007 | Dulaney | D7/555 |
| 7,552,840 | B2 | | 6/2009 | Gitschlag et al. | |
| D699,514 | S | * | 2/2014 | Lovley et al. | D7/409 |
| 2006/0029698 | A1 | * | 2/2006 | Watson et al. | 426/231 |

OTHER PUBLICATIONS

The Physics of Flying Discs, Eugene Motoyama, Dec. 13, 2002, pp. 1-13.

* cited by examiner

*Primary Examiner* — Kurt Fernstrom
(74) *Attorney, Agent, or Firm* — Kirschstein, et al.

(57) ABSTRACT

An aerodynamic device includes a plate having a generally circular periphery, a central portion, and a plurality of compartments for holding food substances during a dining activity. Each compartment is bounded by curved ribs, each rib extending continuously from the central portion along an arcuate path to the periphery. All of the ribs are aerodynamically shaped to provide lift during a subsequent recreational activity in which the device is thrown through the air. An insert is mounted in the central portion for holding a dining item, e.g., a drink container, for use during the dining activity, and a different recreational item for use during the recreational activity.

23 Claims, 7 Drawing Sheets

FIG. 14
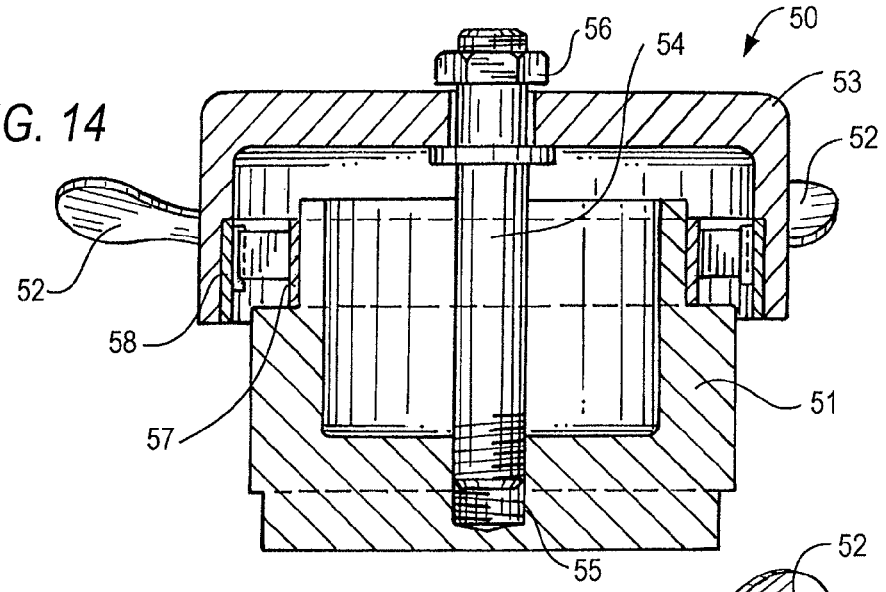
FIG. 15
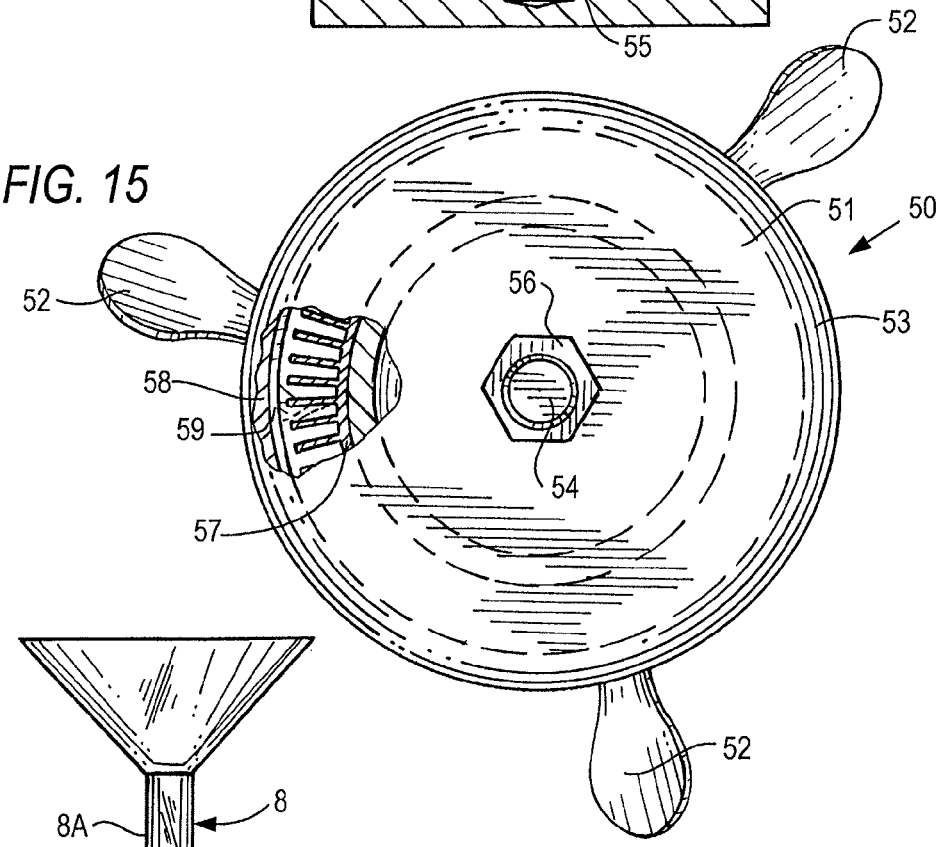
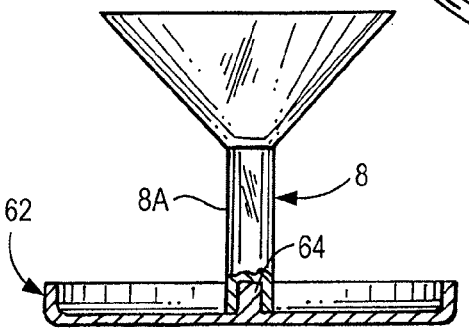
FIG. 16

AERODYNAMIC DEVICE FOR USE IN ORGANIZING AND HOLDING FOOD AND LIQUID SUBSTANCES AND EATING UTENSILS AND FOR SUBSEQUENT RECREATIONAL USE

CROSS REFERENCE TO RELATED APPLICATION

This application claims priority to U.S. Provisional Patent Application Ser. No. 61/771,428, filed Mar. 1, 2013, and to U.S. Provisional Patent Application Ser. No. 61/790,285, filed Mar. 15, 2013, the entire contents of both of which are hereby expressly incorporated herein by reference thereto.

FIELD OF THE DISCLOSURE

The present disclosure generally relates to an aerodynamic device having a plate for use in organizing and holding food and liquid substances and eating utensils during a dining activity, and for promoting subsequent recreational use by configuring the plate with aerodynamically-shaped, curved ribs bounding food compartments that rotate the plate with gyroscopic inertia, and that provide elevation and lift to the aerodynamic device in accordance with Bernoulli's principle, when the aerodynamic device is thrown through the air, for example, during a "throw-and-catch" recreational sports activity. Still more particularly, the aerodynamic device can be used for dispensing items of various types, and/or for emitting light and/or broadcasting sounds in various light and/or sound patterns, and/or for moving on-board components of the aerodynamic device, and/or for generating electricity to charge and energize electrical components on the aerodynamic device, when the aerodynamic device is either thrown through the air, or when facing the wind.

BACKGROUND

Guests fill their plates with food served buffet-style at social functions, and typically either hold their plates in cantilever fashion by gripping peripheral edges of the plates, or balance their plates on their laps. If drinks are also served, the guests typically either hold their drink containers in their other hands, or balance the drink containers on their plates. Due to the difficulty in performing such balancing, and due to the difficulty of supporting the plates and the drink containers without food or liquid spillage, guests often seek out a table or like supporting surface or even the floor, to support their plates and drink containers. Yet, this action tends to anchor guests to a specific location and prevents the guests from roaming and socializing. In a similar vein, customers of take-out or drive-through restaurants, snack bars, concession stands, and like premises, who are served food on plates and drinks in drink containers, often find it difficult to support them all without spillage, especially when leaving and carrying the food and drink away from the premises for subsequent consumption at another location, for example, at their homes, in their vehicles, or in their seats at movies, concerts, sporting events, etc.

Another problem resides in the management of eating utensils. Once an individual has been served with food on a plate and a drink in a container, there is usually no room, or available hand, for holding eating utensils. Since a food-laden plate is typically held in one hand and a liquid-filled drink container is typically held in the other hand, the utensils are often stuck directly into the food or placed on top of the food, or perhaps placed in one's pocket, if available. As the individual proceeds from place to place, the jarring from walking sometimes causes the utensils to fall off the plate, in which case the individual is more or less helpless to retrieve them.

After consumption of the food and drink, the known plates are typically discarded. Yet, it would be desirable not to simply throw the plates away in the trash, but to encourage and motivate some sort of physical, preferably outdoor, activity, not only to enhance the happy, fun atmosphere of the social function, but also to fight obesity by having the individuals exert themselves physically.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the instant disclosure, and explain various principles and advantages of those embodiments.

FIG. 14 is a sectional view of yet another modification of the insert for incorporation into the device.

FIG. 15 is a broken-away, top plan view of the modification of FIG. 14.

FIG. 16 is a perspective view of yet another modification of the insert for incorporation into the device.

Figure 1:
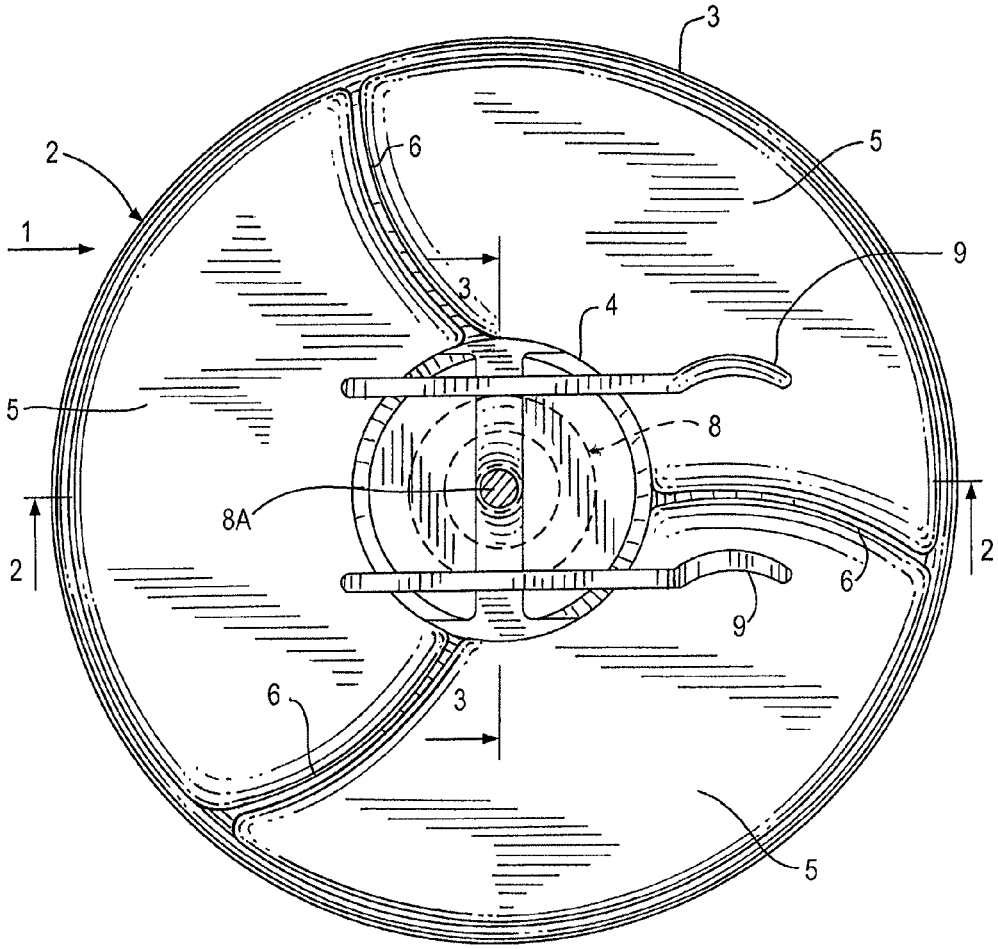
FIG. 1 is a top plan view of an aerodynamic device in accordance with this disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present disclosure.

The components of the aerodynamic device have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

In accordance with one aspect of this disclosure, an aerodynamic device includes a plate having a periphery, preferably generally circular, surrounding an axis, a central portion, and a plurality of compartments for holding food substances during a dining activity. Each compartment is bounded by aerodynamically-shaped ribs, each rib extending continuously from the central portion along an arcuate path to the periphery. The aerodynamically-shaped ribs have contoured surfaces configured to rotate the plate with gyroscopic inertia about the axis when exposed to air motion. Each rib has a height, as considered along the axis, that decreases along the arcuate path from the central portion to the periphery. The contoured surfaces are wing-shaped to provide lift and elevation to the plate in accordance with Bernoulli's principle when exposed to the air motion. All of the ribs are aerodynamically shaped to provide elevation and lift during a subsequent recreational activity in which the aerodynamic device is thrown through the air. During such flight, the aerodynamically-shaped ribs provide a propeller effect. Preferably, an insert is mounted in the central portion for holding a dining item, e.g., a container for containing a liquid substance, such as a beverage, and/or eating utensils, for use during the dining activity, and for holding and/or activating a different recreational item, as detailed below, during the recreational activity. Preferably, a finger hole extends through the plate underneath the insert to enable a user to insert a finger, preferably the thumb, through the finger hole and to hold and support the aerodynamic device during the dining activity adjacent a center of gravity of the aerodynamic device. The thumb is completely isolated from the food, thereby enhancing hygienic and sanitary dining. Only one user's hand is needed to support the aerodynamic device during the dining activity.

In a preferred embodiment, there are three compartments and three aerodynamically-shaped ribs, which are curved, rotationally symmetrical, and face in the same clockwise or counterclockwise direction, and together resemble a propeller. When the aerodynamic device is thrown during the subsequent recreational activity, these ribs serve to lift and elevate the aerodynamic device in accordance with Bernoulli's principle, and also serve to rotate the plate with gyroscopic inertia, to enhance the flying movement and extend the flying range. The aerodynamic device can be designed to suit left- or right-handed users, since the plate can be spun and rotated in the air in opposite circumferential directions, when thrown with the right, or the left, hand.

Figure 3:
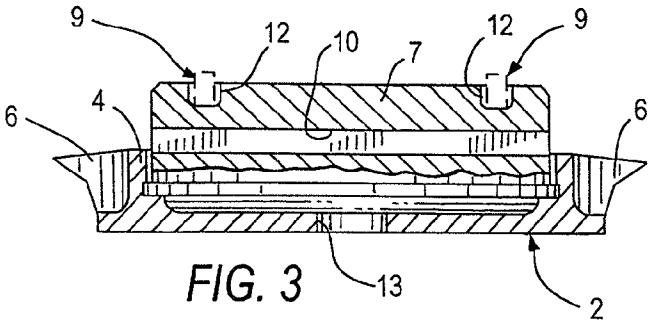
FIG. 3 is a broken-away, sectional view taken on line 3-3 of FIG. 1.
Figure 2:
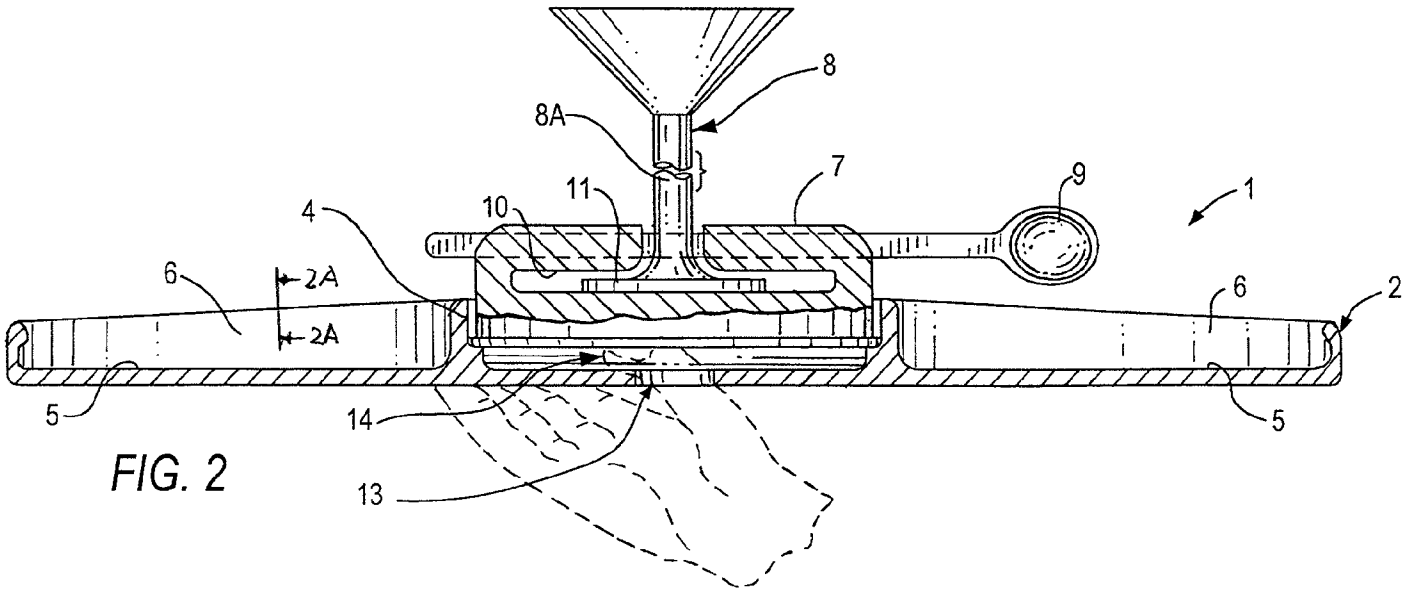
FIG. 2 is a sectional view taken on line 2-2 of FIG. 1, and showing one type of drink container held in one embodiment of an insert of the aerodynamic device.
Figure 2A:
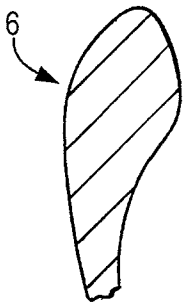
FIG. 2A is a sectional view taken on line 2A-2A of FIG. 2.

Turning now to FIGS. 1-3 of the drawings, reference numeral 1 generally identifies a portable, multiple use, aerodynamic device that includes a plate 2 having a generally circular periphery 3, a hollow cylindrical central portion 4, and a plurality of compartments 5 for holding food substances during a dining activity. The food substances may comprise any edible substances. Each compartment 5 is bounded by a pair of aerodynamically-shaped, curved elongated ribs 6, each rib 6 extending continuously from the central portion 4 along an arcuate path to the periphery 3. Although three ribs 6 and three compartments 5 have been illustrated, a different number of ribs 6 and a different number of compartments 5 are also within the scope of this disclosure. One or more, or all, of the ribs 6 may have a height, as considered along the axis, that decreases along the arcuate path from the central portion to the periphery, or one or more of the ribs may have a constant height, or different constant heights. All of the ribs 6 are aerodynamically shaped to provide lift and elevation in accordance with Bernoulli's principle during a subsequent recreational activity when the device 1 is thrown through the air, as described below. Thus, as shown in FIG. 2A, each rib 6 has bulging, contoured surfaces that are wing shaped. During such flight, the aerodynamically-shaped ribs 6 provide a propeller effect and rotate the plate 2 with enhanced gyroscopic inertia about the axis. The plate 2 is balanced during such rotary motion. A discussion of Bernoulli's principle and of gyroscopic inertia can be found in the publication "*The Physics of Flying Discs*", by Eugene Motoyama, published Dec. 13, 2002. The plate 2 may be made of a disposable, biodegradable material such as paper or cardboard, or of a more permanent material, such as metal, plastic, etc., for re-use.

An insert 7 is mounted, e.g., by a friction fit, or by snap action, or by threading, or by any like connection, in the central portion 4 for holding a dining item, e.g., a container 8 having a stem 8A and a base 11 (as shown in FIG. 2, a stemmed glass) for containing a liquid substance to be consumed. The liquid substance can, for example, be water, or any beverage, either hot or cold, either alcoholic or non-alcoholic. Examples of beverages include, but are not limited to, soda, cocktails, champagne, juice, milk, milkshakes, coffee, tea, hot chocolate, etc. The liquid substance can also be any semi-liquid or semi-solid substance, such as soup, ice cream, yogurt, custard, sherbet, ices, etc. The dining item supported by the insert 7 can also comprise eating utensils 9, such as a knife, fork, spoon, or a pair of chopsticks for use during the dining activity. The insert 7 also can hold a different recreational item, as detailed below, during a subsequent recreational activity.

Figure 5:
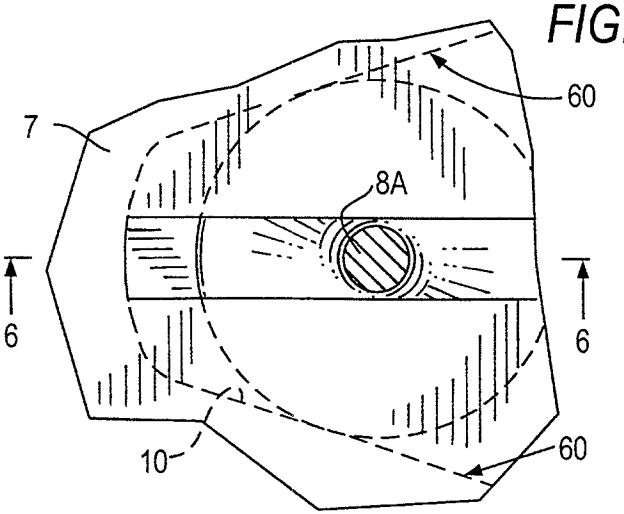
FIG. 5 is a broken-away, top plan detail of an alternate modification.

As shown in FIG. 2, the insert 7 has a T-shaped channel 10 in which the stem 8A, and the base 11, of the container 8 are received and held. The channel 10 is open at least at one end thereof to permit sliding entry of the stem 8A and the base 11 therein. As shown in FIG. 5, the channel 10 may have inclined side walls 60 that converge in a direction away from the open end of the channel 10 to frictionally engage the base 11 and prevent accidental sliding movement of the container 8. As shown in FIG. 3, the insert 7 also has upwardly-open slots 12 in which the eating utensils 9 are received and held in a friction, snap-type fit. Advantageously, the eating utensils 9 help prevent the container 8 from sliding through the channel 10 and falling off the plate 2, especially if the plate 2 were tilted.

A finger hole 13 extends through the plate 2 underneath the insert 7 to enable a user to insert a finger, preferably the thumb 14, through the finger hole 13 and to hold and support the device 1 during the dining activity adjacent a center of gravity of the device 1. The thumb 14 is completely isolated from the food substances in the compartments 5, thereby enhancing hygienic and sanitary eating. Only one user's hand 15 is needed to support the device 1 during the dining activity.

Figure 7:
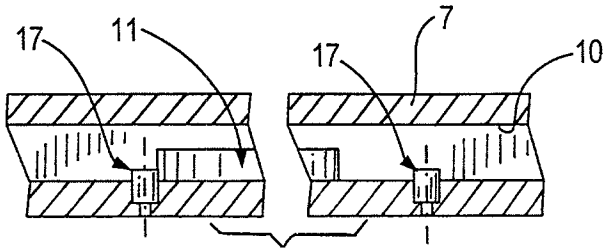
FIG. 7 is a broken-away detail analogous to FIG. 6, but of an alternate modification.
Figure 6:
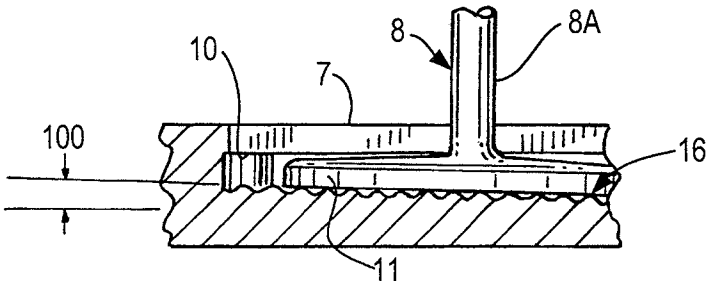
FIG. 6 is a sectional view taken on line 6-6 of FIG. 5.

To keep the container 8 in a more stable position, the bottom surface of the channel 10 may be provided with a roughened or ridged surface 16 (see FIG. 6) to increase the friction with the base 11 of the container 8. The ridged surface 16 can also be positioned in an inclined plane that is either upwardly or downwardly tilted at a horizontal angle 100 to prevent undesired movement of the container 8 and to increase stability. The bottom surface of the channel 10 may alternatively be provided with raised pins 17 (see FIG. 7) to prevent the container 8 from accidentally sliding along the channel 10 and from falling from the plate 2. By slightly lifting up the base 11 of the container 8 above the ridged surface 16 or the raised pins 17, and thereupon sliding the base 11 of the container 8 along the channel 10 and out through the open end of the channel 10, the user can easily remove the container 8 from the channel 10 of the insert 7.

Figure 8:
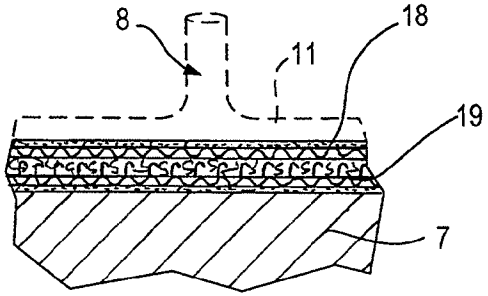
FIG. 8 is a broken-away detail analogous to FIG. 6, but of another alternate modification.

Alternatively, as shown in FIG. 8, the base 11 of the container 8 may be adhered to one side 18 of a double-sided tape or other type of detachable fastener, e.g., Velcro, whose opposite side 19 is attached to a convenient location on the device 1, for example, the top surface of the insert 7. The container 8 may thus be conveniently attached to, and detached from, any support surface, e.g., a table, and especially from the device 1.

Figure 4:
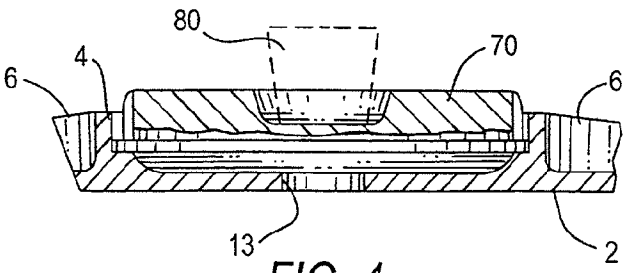
FIG. 4 is a broken-away, sectional view that shows an alternative embodiment of an insert for holding another type of drink container.
Figure 10:
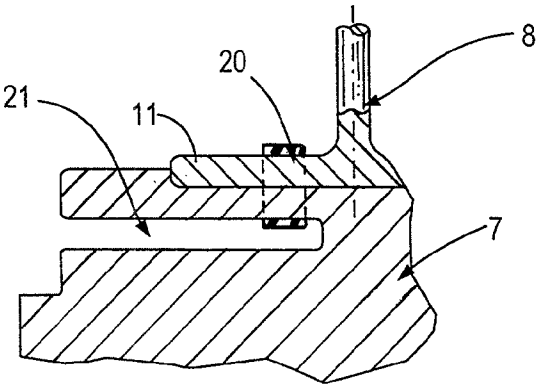
FIG. 10 is a broken-away, sectional view taken on line 10-10 of FIG. 9.
Figure 9:
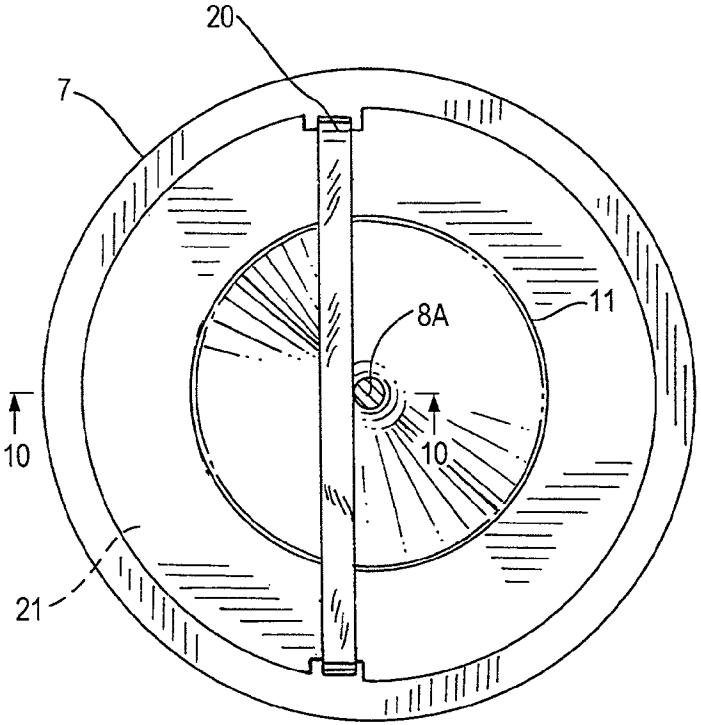
FIG. 9 is a top plan view of another construction.

Another alternative design (see FIGS. 9-10) is to form an upper region of the insert 7 with a slot 21, and to position an elastic, rubber-like band 20 in the slot 21 with enough clearance above the insert 7 to allow the base 11 of the container 8 to be slid underneath the band 20 and to be securely resiliently captured by the band 20 against the insert 7. The insert 7 is also formed with a diametrically opposed grooves in which the band 20 is received and held in a fixed position. Each groove may be formed with a tapered wall to help guide and secure the band 20 in each groove. This design allows different sizes of bases 11 of containers 8 to be adjustably accommodated and held in a firm, stable position. FIG. 4 is analogous to FIG. 3, but shows a modified insert 70 on which another type of container 80 is mounted. Thus, the container 80 need not be a stemmed glass, but can be any cup, bowl, or like vessel that can hold a liquid substance, as described above.

As described so far, during an eating and/or drinking or analogous dining activity, the plate 2 of the device 1 can hold food substances in the food compartments 5; and, in addition, the inserts 7, 70 of the device 1 can hold liquid substances in the containers 8, 80 and/or the inserts 7, 70 can hold the eating utensils 9. Once the eating and/or drinking activity is over, the device 1 need not be discarded as in the known art, but can be used for a different purpose, such as in recreation, in which the device 1 is thrown through the air. The thrown device 1 can be tossed back-and-forth during a "throw-and-catch" recreational sports activity, in which the aerodynamically-shaped ribs 6 on the plate 2 advantageously provide elevation and lift to the device 1 in accordance with Bernoulli's principle, and also rotate the device 1 with gyroscopic inertia about the axis to extend its flying range. The thrown device 1 can also be used for activating recreational items supported by the inserts 7, 70, such as by dispensing recreational items of various types, and/or by emitting light and/or broadcasting sounds in various light and/or sound patterns, and/or by moving onboard components of the device 1, and/or by generating electricity to charge and energize electrical components on the device 1, during flight. Prior to throwing the device 1, the inserts 7, 70 may or may not be removed from the central portion 4, but the food substances and the containers 8, 80 are, of course, advantageously removed.

Figure 11:
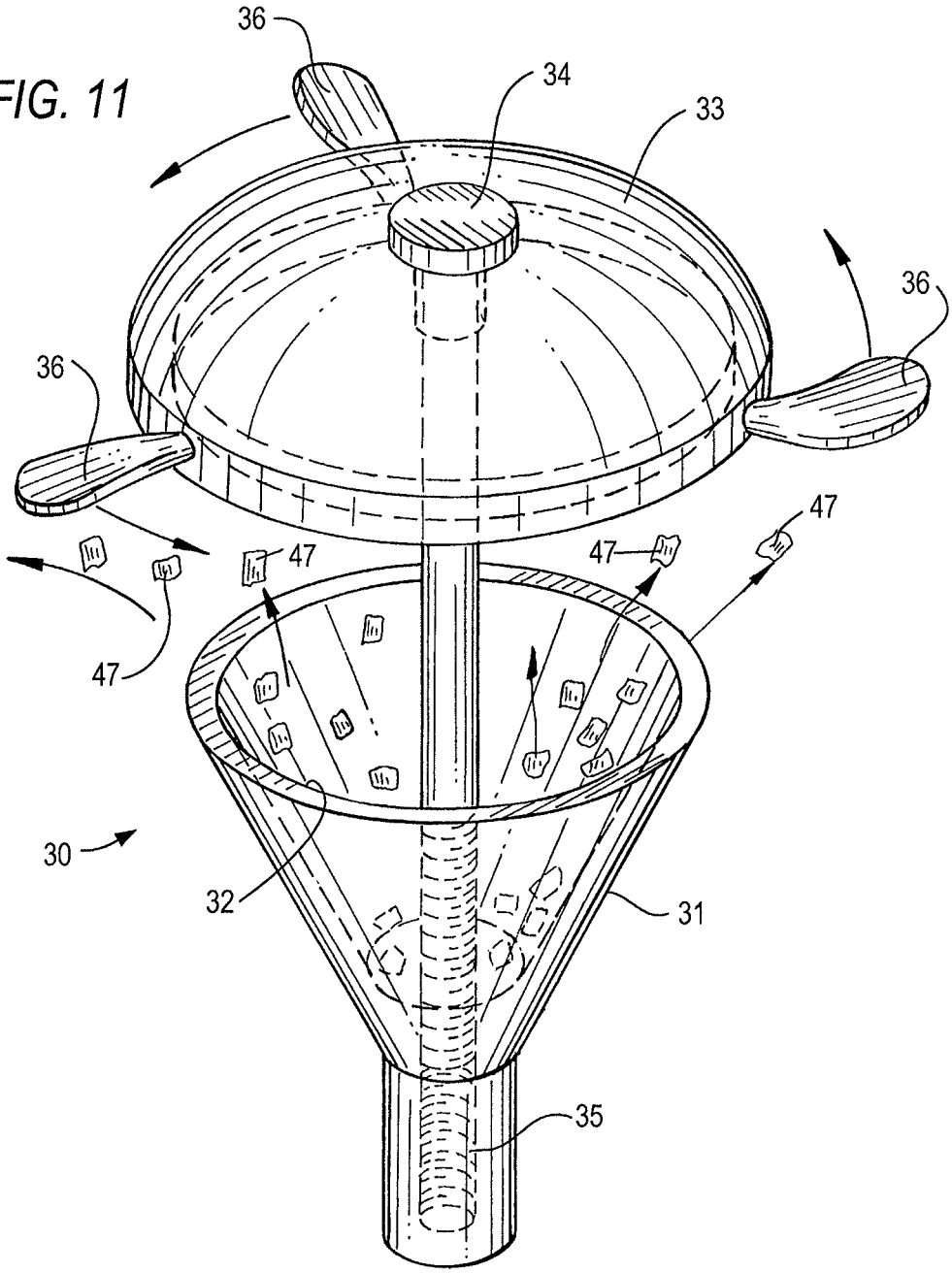
FIG. 11 is a perspective view of yet another modification of the insert for incorporation into the device.

As shown in FIG. 11, the inserts 7, 70 have been removed, but have been replaced by a dispenser-type insert 30, which is now mounted in the central portion 4 of the plate 2. The insert 30 comprises a lower housing 31 bounding an interior 32 and stationarily mounted, e.g., by a friction fit, or by snap action, or by threading, or by any like secure connection, in the central portion 4, and a rotary top cover 33 that is mounted on the housing 31 for turning movement on, around, and axially along, a headed, elongated, stationary shaft 34 whose lower end is mounted in a bottom compartment 35. Preferably, the shaft 34 is threaded in the compartment 35 so that the position of the head of the shaft 34 is adjustable lengthwise of the shaft 34.

A plurality of propeller blades 36 on the cover 33 is responsible for turning the cover 33. The propeller blades 36 extend outwardly of the cover 33 and are arranged about an axis along which the shaft 34 extends. Although three propeller blades 36 have been illustrated, a different number of propeller blades 36 are also within the scope of this disclosure. The pitch of the propeller blades 36 can be adjusted. The propeller blades 36 can be integral with the cover 33, or configured as discrete elements that are individually mounted on the cover 33. The propeller blades 36 can rotate the cover 33 in either circumferential direction of rotation and create a propeller effect. Thus, the propeller blades 36 can rotate either in the same direction of rotation as the ribs 6 rotate the plate 2, or in the opposite direction of rotation as the plate 2 is rotated by the ribs 6. When the propeller blades 36 and the plate 2 rotate in opposite directions, if the propeller blades 36 are properly adjusted and positioned, then the time of flight may be considerably increased, and, in effect, the device hovers and "hangs in the air", in a manner analogous to a helicopter in flight. The propeller effect caused by the ribs 6 and the propeller effect caused by the propeller blades 36 cooperate to modify the flight trajectory of the device 1 with gyroscopic inertia.

Recreational items 47 of low weight, e.g., confetti, candies, pet treats, small toys, puzzles, cards, lights, just to mention a few possibilities, are loosely mounted in the interior 32 of the housing 31 and are normally retained therein by the top cover 33, which rests directly on the housing 31 prior to throwing the device 1. When the device 1 is thrown, the ribs 6 create the lift, as described above during the flight trajectory, and, in addition, the propeller blades 36 cause the cover 33 to rotate and to raise itself axially along the shaft 34. The extent to which the cover 33 is raised is adjustable, as described above, by adjusting the position of the head of the shaft 34. The head of the shaft 34 prevents the cover 33 from removing itself completely therefrom. After flight, the cover 33 lowers itself back onto the housing 31.

In the elevated position shown in FIG. 11, the lightweight recreational items 47 are now free to escape from the interior 32 of the housing 31 and to be distributed by centrifugal force into the ambient air. For example, confetti may be freely scattered throughout an area hosting a party, or candies can be freely dispensed throughout an area hosting a piñata-type celebration, or pet treats can be distributed throughout an area populated with pets, or toy soldiers can be launched into the air and then allowed to float down by parachutes, etc. For greater entertainment value, multiple inserts 30 can be mounted on the plate 2, each insert 30 being configured to dispense the same or different recreational items 47. Other recreational items may include jigsaw puzzle pieces and letters for educational word games or foreign language instruction.

Figure 12:
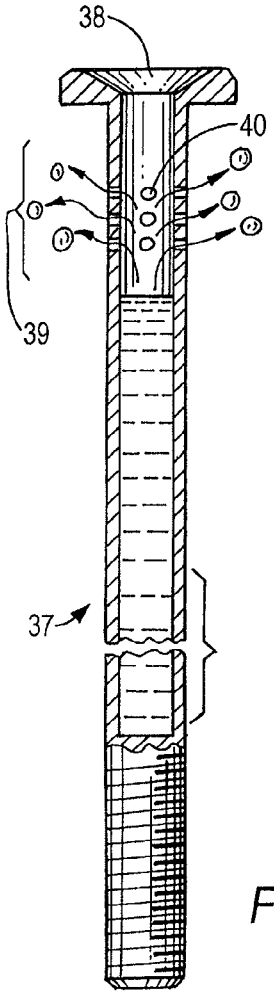
FIG. 12 is a sectional view of a modification of the embodiment of FIG. 11.

In a variant construction, the shaft 34 of FIG. 11 could be replaced by a shaft 37 of FIG. 12. The shaft 37 has an interior 38 that can be filled with a soapy solution. An upper region 39 of the shaft 37 is formed with transverse passages 40. During flight, the rotating cover 33 is raised up axially along the shaft 37 to expose the upper region 39, thereby allowing bubbles to freely escape the passages 40 by centrifugal force created by the freely flying rotating plate 2.

Figure 13:
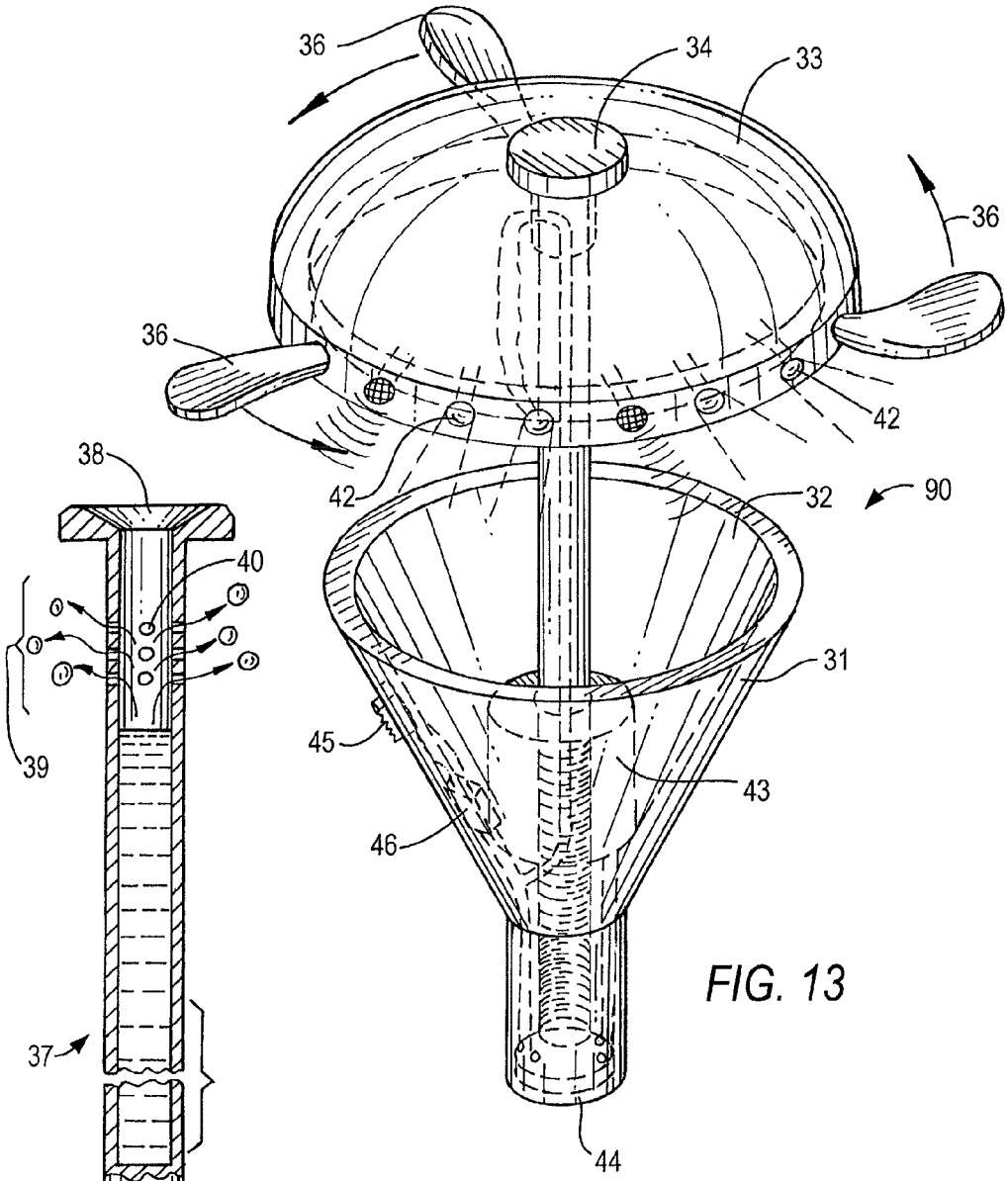
FIG. 13 is a perspective view of an additional modification of the insert for incorporation into the device.

In another variant construction, the dispenser-type insert 30 of FIG. 11 could be replaced by the dispenser-type insert 90 of FIG. 13, in which like reference numerals have been used to identify like parts. The insert 90 is provided with sound and/or light indicators 42 arranged around the cover 33, a rechargeable battery 44 mounted within the housing 31, and a generator 43 also mounted within the housing 31 and operative for recharging the battery 44 during flight of the device 1. Thus, the battery 44 and/or the generator 43 can be used to energize the indicators 42. If such energization is desired when the device 1 is not in flight, then an electrical switch 45 mounted on the housing 31 may be manually actuated. A controller 46 may be provided to control how the indicators 42 are energized, for example, in various lighting and/or sound patterns and sequences. In addition, rather than relying on flight to rotate the cover 33 by the propeller blades 36, the device 1 may be stationarily positioned in a windy area, in which case, the propeller blades 36 and the cover 33 are rotated by the wind, and the generator 43 generates and stores electricity, or energizes the sound and/or light indicators 42. Again, as before, the propeller blades 36 can rotate the cover 33 in either circumferential direction of rotation and create a propeller effect. Thus, the propeller blades 36 can rotate either in the same direction of rotation as the ribs 6 rotate the plate 2, or in the opposite direction of rotation as the plate 2 is rotated by the ribs 6.

FIGS. 14-15 depict another embodiment of an insert 50 that is mounted, in a manner analogous to that of the insert 7, e.g., by a friction fit, or by snap action, or by threading, or by any like connection, in the central portion 4 of the plate 2. The insert 50 comprises a lower housing 51, and a rotary top cover 53 having a plurality of radially extending propeller blades 52. The top cover 53 is mounted on the housing 51 for turning movement on and around a stationary shaft 54 whose lower end is adjustably mounted in a bottom compartment 55. Preferably, the shaft 54 is adjustably threaded in, and lengthwise of, the compartment 55. A nut 56 adjustably secures the top cover 53 from being raised and from becoming detached from the housing 51 during the turning of the cover 53. The propeller blades 52 rotate the top cover 53, either during flight, or when simply being positioned in a windy area. The propeller blades 52 can rotate the cover 53 in either circumferential direction of rotation and create a propeller effect. Thus, the propeller blades 52 can rotate either in the same direction of rotation as the ribs 6 rotate the plate 2, or in the opposite direction of rotation as the plate 2 is rotated by the ribs 6.

A selected inner ring 57 of a plurality of inner rings is stationarily mounted, e.g., by a threaded connection or like means, on an upper region of the housing 51, and a selected outer ring 58 of a plurality of outer rings is mounted at the interior of the top cover 53 for joint turning therewith. The inner and outer rings 57, 58 are coaxially arranged, engage each other, and generate sounds during the turning of the top cover 53. In one embodiment, the selected inner ring 57 has radial arms, or fingers, or sound-producing segments 59 that physically and mechanically engage the selected outer ring 58, each segment 59 generating a characteristic sound or tone as the respective segment 59 rubs against and passes the outer ring 58. Different segments 59 can have different sound-producing characteristics, i.e., different lengths and/or thicknesses, to generate sounds of different pitch and frequency and, in an advantageous application, they can play a melody or song, like a music box or barrel organ. Different inner rings 57 can play different melodies. The segments 59 may be made of a metal material. The position of the segments 59 could also be reversed so that they are on the outer ring 58. In a variant construction, the sounds can be generated electronically. Thus, the insert 50 can generate sounds when the device 1 is thrown into the air, or when stationarily positioned in a windy area and exposed to moving air currents. In the latter case, the device 1 serves as a wind chime or barrel organ.

FIG. 16 depicts another embodiment of an insert 62 that is mounted, in a manner analogous to that of the insert 7, e.g., by a friction fit, or by snap action, or by threading, or by any like connection, in the central portion 4 of the plate 2. The insert 62 comprises a base member having a central post 64 that is fitted in the stem 8A of the container 8. The base member effectively replaces the base 11 and the insert 7. The embodiment of FIG. 16 can also be used independently of the plate 2; for example, one or more of the embodiments of FIG. 16 can be placed directly on any stationary or mobile support surface, such as a table, car, boat, a serving tray, etc. The support surface can also be modified to have raised portions, such as posts or pins, that receive complementary portions on the stem 8A of the container 8, for a secure anchorage on the support surface, especially for benefit at parties where champagne and cocktails are served. Rather than a two-piece container 8 with a removable base member as shown in FIG. 16, the container 8 and the base member can also be made of one-piece and resemble, for example, a champagne glass, in which case, it is desirable to form a recess or bore in the integral base member. This bore can then receive a raised portion, such as a post or a pin, on the aforementioned support surface, thereby serving as a convenient way to securely hold the champagne glass in position on the support surface.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. For example, the above-described adjustment to the propeller blades 36 and the above-described adjustment to the shaft 34 may be performed individually or in combination.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to, as understood by one of ordinary skill in the art. The term "coupled" is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims.

In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An aerodynamic device, comprising:

a plate having a periphery surrounding an axis, a central portion, and a plurality of compartments for holding food substance during a dining activity, each compartment being bounded by aerodynamically-shaped ribs, each rib extending continuously and uninterruptedly from the central portion along an arcuate path to the periphery to prevent the food substances from leaving the compartments through openings in the ribs, the aerodynamically-shaped ribs having contoured surfaces configured to rotate the plate with gyroscopic inertia about the axis when exposed to air motion, the aerodynamically-shaped ribs being rotationally symmetrically arranged about the axis to balance the plate during rotation about the axis.

2. The device of claim 1, wherein at least one of the aerodynamically-shaped ribs has a height, as considered along the axis, that decreases along the arcuate path from the central portion to the periphery.

3. The device of claim 1, wherein the contoured surfaces are riving-shaped to provide lift and elevation to the plate in accordance with Bernoulli's principle when exposed to the air motion.

4. The device of claim 1, and an insert mounted in the central portion for holding a dining item for use during the dining activity.

5. The device of claim 4, wherein the dining item includes a container for holding a liquid substance, and wherein the container is mounted on, and removable from, the insert.

6. The device of claim 5, wherein the container has a base, and wherein the insert has an interior channel for receiving the base.

7. The device of claim 6, wherein the interior channel has tapered side walls for frictionally engaging and holding the base within the interior channel.

8. The device of claim 6, wherein the interior channel has a roughened, tilted surface for frictionally engaging and holding the base within the interior channel.

9. The device of claim 6, wherein the interior channel has stop pins for frictionally engaging and holding the base within the interior channel.

10. The device of claim 5, and a pair of complementary fasteners, one on the insert, and the other on the container, for holding the container on the insert.

11. The device of claim 5, wherein the container has a base, and wherein the insert has a recess, and a resilient band received in the recess for resiliently engaging and capturing the base to hold the container on the insert.

12. The device of claim 5, wherein the insert has an interior cavity, and wherein the container has a detachable base received in the cavity during the dining activity.

13. The device of claim 4, wherein the dining item includes an eating utensil mounted on, and removable from, the insert.

14. The device of claim 5, wherein the dining item includes a pair of eating utensils mounted on the insert at opposite sides of the container to resist the container from unwanted removal from the insert.

15. The device of claim 4, and a finger hole extending through the plate underneath the insert to enable a user to place a finger through the finger hole to hold and support the device during the dining activity adjacent a center of gravity of the device.

16. The device of claim 4, wherein the insert is operative for activating a recreational item during a recreational activity in which the device is thrown and spun through the air.

17. The device of claim 16, wherein the insert includes a stationary housing part fixedly mounted in the central portion, and a rotary housing part having radial blades for rotating the rotary housing part relative to the stationary housing part about the axis during the recreational activity.

18. The device of claim 17, wherein the recreational item includes a plurality of recreational items mounted within an interior of the stationary housing part, and wherein the blades are operative for raising the rotary housing part relative to the stationary housing part during the recreational activity to dispense the recreational items past the raised rotary housing part by centrifugal action.

19. The device of claim 17, wherein the recreational item is an electrically energizable emitter for emitting at least one of light and sound, and wherein the blades are operative for generating electrical power to energize the emitter during rotation of the rotary housing part relative to the stationary housing part about the axis.

20. The device of claim 19, and a rechargeable battery and a generator for charging the battery with DC power during rotation of the rotary housing part relative to the stationary housing part about the axis; and a switch for supplying electrical power to energize the emitter when the rotary housing part is not rotating about the axis.

21. The device of claim 17, wherein the recreational item includes a pair of rings respectively mounted on the stationary and rotary housing parts, one of the rings having arms that frictionally engage the other of the rings to generate sound as the arms move past the other ring during rotation of the rotary housing part relative to the stationary housing part about the axis.

22. The device of claim 4, wherein the insert is operative for activating a recreational item when exposed to the air motion.

23. An aerodynamic device, comprising:

a plate having a periphery surrounding an axis, a central portion, and a plurality of compartments for holding food substances during a dining activity, each compartment being bounded by aerodynamically-shaped ribs, each rib extending continuously from the central portion along an arcuate path to the periphery, the aerodynamically-shaped ribs having contoured surfaces configured to rotate the plate with gyroscopic inertia about the axis when exposed to air motion during a recreational activity in which the device is thrown and spun through the air, the contoured surfaces being wing-shaped to provide lift and elevation to the plate in accordance with Bernoulli's principle when exposed to the air motion; and an insert mounted in the central portion for holding a dining item for use during the dining activity, and for holding a recreational item for use during the recreational activity.

* * * * *